United States Patent [19]

Predali

[11] 4,175,790

[45] Nov. 27, 1979

[54] PROCESS FOR THE PRECONCENTRATION OF METALLIFEROUS PRODUCTS

[75] Inventor: Jean-Jacques Predali, Elancourt, France

[73] Assignee: Minemet Recherche, Trappes, France

[21] Appl. No.: 878,458

[22] Filed: Feb. 16, 1978

[30] Foreign Application Priority Data

Feb. 16, 1977 [FR] France ..... 77 04361

[51] Int. Cl.[2] ..... B02C 23/08; B02C 23/18

[52] U.S. Cl. ..... 299/7; 241/24; 299/17

[58] Field of Search ..... 299/7, 17; 241/24; 175/66

[56] References Cited

U.S. PATENT DOCUMENTS

| | | | |
|---|---|---|---|
| 821,516 | 5/1906 | Lovett | 241/24 |
| 2,175,484 | 10/1939 | Rees et al. | 241/24 X |
| 2,464,313 | 3/1949 | Weinig et al. | 241/24 X |
| 3,326,607 | 6/1967 | Book | 299/17 X |
| 3,411,870 | 11/1968 | Nightingale | 241/24 X |
| 3,472,325 | 10/1969 | Lummus | 175/66 |
| 4,074,865 | 2/1978 | Gibbon | 241/24 X |

*Primary Examiner*—Ernest R. Purser
*Attorney, Agent, or Firm*—Fleit & Jacobson

[57] ABSTRACT

The invention provides a process for the preconcentration of metalliferous values contained in metal-bearing ore materials (ores and byproducts thereof) and involves subjecting the ore material to careful attrition to obtain a particle mixture of fine and coarse particles, separating the fine particles from the coarse particles by granulometry, and recovering from the thus-separated fine particles a cut having a particle size not exceeding about 50 microns and containing the metalliferous values in concentrated form.

22 Claims, 2 Drawing Figures

PROCESS FOR THE PRECONCENTRATION OF METALLIFEROUS PRODUCTS

The present invention relates to and has as its goal a new process for the preconcentration of metal bearing values contained in an ore material, such as an ore or byproduct thereof. It concerns more specifically the enrichment of metal-bearing values contained in ores such as uranium ores with carbonized gangue, manganese ores of sedimentary origin, phosphate ores with clay gangue and/or carbonate containing gangue, bauxite ores with a breccia structure where the bauxite is accompanied by silicified limestone, talc ores associated with a schist and a granite gangue and containing fine amounts of dolomite and of pyrite, and ore byproducts, such as factory residues of zinc and siderurgical dusts recovered from the exhausts of blast-furnaces and steelworks.

Many techniques for physical enrichment are known. The main ones are: magnetic, electrostatic, and gravimetric separations, selective flocculation, and selective flotation. However, these techniques do not produce satisfactory results when they are applied to the ore materials listed above. For example, they do not permit the elimination of the carbonate containing gangue from the uranium ores whose presence makes the use of acid for lixiviation thereof expensive as a reagent since it is not possible to submit ores to an acid treatment without simultaneously neutralizing the oxides and carbonates which they contain.

This is why ores or the byproducts listed above, which have in common the difficulty that they present in being enriched according to classical techniques and the extreme dispersion of their valuable elements in a sterile gangue, are only rarely exploited. In fact, the absence of a preconcentration technique which is well adapted to them makes it necessary to exploit only those very high grade ores, which means that there are few exploitable veins and reserves.

This is why one of the aims of the present invention is to furnish a process of preconcentration which fills a gap in the area of the application of methods of physical enrichment.

Another aim of the present invention is to supply a preconcentration process which is well adapted to the ores mentioned above.

According to the invention, these goals as well as others which will appear shortly are attained by means of the process described below.

This process is characterized by the fact that it includes the following steps:

(a) the ore material is subjected to a carefully adjusted attrition; and (b) the attrited ore is ranked into two granulometric portions, with the size of the cut being at least equal to 50 microns.

At this step in the description of the process, it is necessary to recall and to define more precisely the process of well adjusted attrition. This term is in fact sometimes used to refer to a mild grinding or a simple washing. In the remainder of this description, the expression "careful attrition" or "well adjusted attrition" or simply "attrition" will not refer to either of these two operations. The operation of washing, crumbling, or elutriation consists essentially of separating some fine particles from others already existing in the ore or the byproduct while the attrition operation aims at creating new ones. It is expendient also to point out that the operation of washing lasts only a few minutes whereas the attrition lasts at least ten and preferably at least 20 minutes.

In contrast to blunt fragmentation, well adjusted attrition wears down and shakes the ore particles without shattering them. This wearing down and these jolts are produced by friction and by collisions among the particles. It is thus a question of producing a moderate mechanical action which frees the friable particles present in the ore particles, without producing the splintering of the harder parts.

It follows that, on a Rosin-Rammler granulometric diagram, the successive curves, compared to the right-hand lines, corresponding to the granulometries obtained by successive attritions have a tendency to become horizontal, while those which correspond to the granulometries obtained by successive grindings remain parallel to themselves or have a slight tendency to become vertical.

Figure 1:
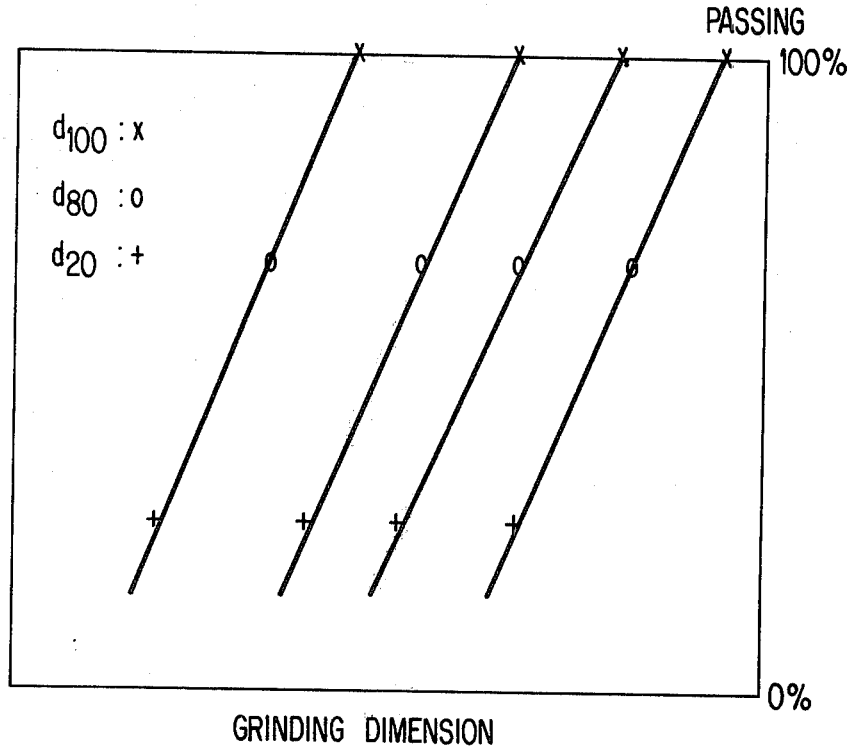
FIGS. 1 and 2 are Rosin-Rammler granulometric diagrams.
Figure 2:
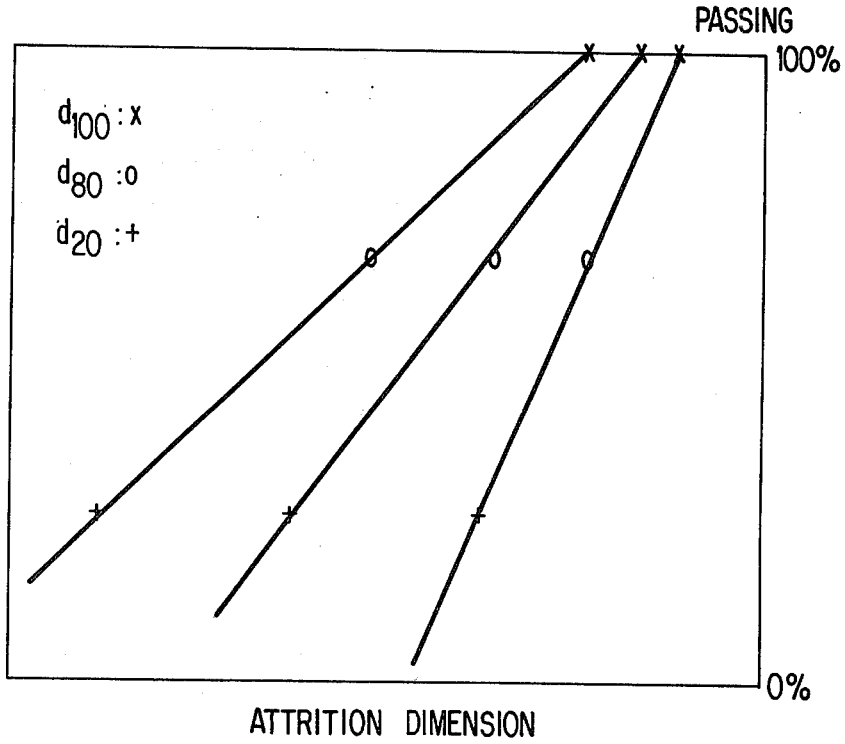

If one refers to the two Rosin-Rammler diagrams sketched as FIGS. 1 and 2, one notices that in the case of grinding (FIG. 1) the right-hand lines representing the granulometry move parallel to themselves, the $d_{100}$, defined as being the smallest mesh which permits 100% of the product to pass through, moves as the other points of the right-hand. In the case of attrition (FIG. 2), on the contrary, the slope of the successive lines to the right decreases while the $d_{100}$ changes only a little or not at all. In general, the d of the high mark changes little while the d of the low mark changes very much with the entire time of attrition.

It is necessary to notice that the right-hand lines representing successive attritions cannot in any case have a slope lower than that of the right-hand line passing through the first $d_{100}$ and a $d_0$ corresponding to the molecular size of the most fragile phase.

Although examination of a Rosin-Rammler diagram is the most exact criterion and the best adapted for differentiating the attrition adjusted with grinding, one may turn to other criteria which may be termed secondary.

The first secondary criterion is to define adjusted attrition by the fact that the $d_{100}$ does not decrease more than 50% and, preferably, not more than 25% in the course of attrition, however long it may be. Nevertheless, this criterion is not very satisfactory since the $d_{100}$ corresponds to the dimension of the largest particle. This characteristic makes this secondary criterion usable.

As another secondary criterion, it is also possible to define adjusted attrition by the fact that in the course of attrition, the $d_{90}$ and the $d_{80}$ do not decrease respectively more than 75 and 100% and preferably respectively not more than 30 and 20%.

Finally, the secondary criterion which is the most satisfactory consists in defining adjusted attrition by the fact that the $d_{80}/d_{20}$ relationship grows in the course of successive attritions.

If the techniques of attrition are little known or not at all known, the techniques of grinding are very well known and it is possible to define the conditions of attrition in contrast to those of grinding.

The mills usually used in the mining industry are constructed to break mineral particles into fragments by producing an impact between them and grinding bodies designed for that purpose; wearing away by friction between different bodies present in the mill is only an accompanying phenomenon, even an interfering one, since the fine particles are always considered a source of difficulties in final mineralurgical treatments. Therefore, in the case of grinding by means of rotating mills, one regulates the speed of rotation and the size of the grinding bodies in such a fashion that one obtains the breakage of all of the particles. The speed of rotation is in general chosen between 60% and 80% of the critical speed, the latter being defined as the speed at which the load begins to be centrifuged and can no longer produce its effect of a waterfall on the mineral particles.

It is also known how to determine the optimal dimensions of the grinding bodies by means of more or less empirical equations, as, for example, those of Rittinger (Ritter von Rittinger, P. Lehrbuch der Aufbereitungskunde, p. 1922, Berlin, 1867), Coghill (Coghill W. H.; de Vaney, F. D., Bull. Mo. Sch. Min. Tech. Ser. Sept. 1938), and Bond (Bond, F. C., A.I.M.E. Trans. 193, p. 484, 1952).

This optimization of grinding has been the subject of many publications which are summarized in the work of P. BLAZY, *The Processing of Ores,* Presses Universitaires de France, Paris 1970, especially pages 42 to 44.

Thus, the technician, knowing the parameters which play an important role in the technique of grinding and the conditions which permit one to obtain a good fragmentation, may determine, in contrast, the conditions for a satisfactory, well adjusted attrition; for example, by choosing a speed equal to 90% of the critical speed.

Advantageously, one may use as a grinding body the ore particles of between 1 and 5 mm obtained in the preceding operation.

The division and recovery according to step (b) of the invention is carried out according to different classical methods known to the technician; for example, by filtering or sorting.

Attrition may be carried out in a dry format or preferably in a pulp.

Transformation into pulp may be carried out directly on the vein, by adopting a method of exploitation using hydraulic breakdown which necessarily leads to the transformation of the ore into pulp. A good way of carrying out an adjusted attrition into pulp consists in subjecting the latter to an attrition which may for example be managed by means of a turning tank or preferably by means of a simple agitator. Those skilled in the art can easily determine the speed of rotation of the agitator (e.g., from the shape of the propellers) which give a satisfactory attrition for each type of ore or ore by product. The amount of solid in the pulp is advantageously between 40% and 80% and preferably between 65% and 75%. It is necessary to mention that attrition carried out in pulp gives much better results than attrition carried out in a dry format for most ores. The fine particles are separated from the pulp of the coarse particles by the mean of an hydrocyclone.

Before proceeding to the attrition stage, it is often preferable to submit the feed to an ordinary grinding operation.

The particles which are recovered must be smaller than 50 microns and preferably smaller than 10 microns.

Among the numerous factors on which the upgrading of the valuable element depends, one may cite: the origin of the ore, the way in which attrition was administered, the particle size distribution obtained after attrition, the level of the cut off size, and the number of treatments according to the invention undergone by the ore. Generally, the finer the cut, the larger is the recovered portion and the lower is the rate of recovery.

The recovery rate may be improved either by following the attrition to increase the proportion of fine particles or by treating once again the rejected particles with, when necessary, a preliminary grinding. In a surprising fashion, one has been able to judge that the content of fine particles obtained after a second treatment, which one may term secondary particles, is at least equal to that of the fine particles emerging from the first treatment and which one may term primary particles.

One of the best applications of the invention consists in recovering very fine sized portions, then in repeating on the remainder the treatment according to the invention as many times as it is necessary to obtain an acceptable recovery rate while maintaining a strong enrichment of the ore.

However, when they are in the form of pulp, the portions enriched according to the invention, which are formed of fine particles, can only be poorly filtered and decant themselves too slowly in order for the decantation to be used on an industrial scale. It has thus been necessary to look for adjuvants and techniques putting them into operation which speed up decantation and thicken the pulp sufficiently for it to be filtered according to customary techniques to form a cake whose moistness is suitable. It has therefore been necessary to find conditions of pH and of organic flocculants leading to the formation of large flakes which, alone, assure the speed of sufficient decantation.

The preferred flocculants are the organic flocculants containing polar groupings, such as amide, ether, and ester groupings. An example of such flocculants are the polyacrylamides sold under the trademark "SEPARAN," or the polyethyleneglycols sold under the commercial name of "FLOERGER FA 10," or the copolymers of acrylamide and of acrylate sold under the trademark "SEDIPUR T.F.5." It has been observed that the greater the molecular weight of the flocculant, the better was the decantation. Those skilled in the art easily determine the best pH conditions by simple tests according to the technical booklet given by the producer.

Advantageously, the doses of flocculant used range between 100 and 2000 g. per ton of dry treated matter and, preferably, between 100 and 500 g. per ton.

This technique of enrichment by attrition gives, of course, results which vary according to the type of ore treated and it is extremely difficult to foresee in advance which ores are susceptible of being treated according to this technique.

Nevertheless, one should point out that the process of the present invention is suited to, and gives results particularly satisfying for, products as different from each other as uranium ores with carbonate containing gangue, manganese ores of sedimentary origin, phosphate ores with clay gangue or carbonate containing gangue, bauxite ores with a breccia structure where the bauxite is accompanied by silicified limestone, the ores of talc associated with a schist and granite gangue and containing fine amounts of dolomite and pyrites, factory residues of zinc, and, finally, siderurgical dusts recovered from the exhausts of blast-furnaces and steelworks.

A major point of interest of the process lies in its ease of adaptation to the economic requirements of the place and period where one desires to exploit an ore or a byproduct. These characteristics permit one to establish the values which the different parameters, such as the particle size distribution of the treated product and the dimension of the cut, must assume in order to implement the best compromise between content and rate of recovery, and therefore to determine the putting into operation of the best adaptation.

Nevertheless, the fine portion, which is very enriched, may be composed of a restraining element of the ore, in which case the fine portion constitutes the rejected material while the coarser sized portion is the recovered portion.

Generally, when a product includes a fragile phase and a phase which is not fragile, the present invention permits the separation of these two phases by means of a simple operation of granulometric ranking.

One of the characteristics of the present invention lies in the fact that the separation of the two phases may be very complete if one follows for a long time (e.g. half one hour to one hour) (or if one repeats the attrition operation many times) the operations of attrition and of granulometric cutting at very low levels.

It is necessary at this stage of the description to note that the present invention permits the resolution of problems which have been present for a long time.

It is known that there exist considerable reserves of phosphate ore of a low content (lower than 15% of $P_2O_5$ content) formed of apatite in a silicated and/or carbonate containing gangue (calcium carbonate and/or double carbonate of calcium and magnesium). The most commonly used technique for enriching ores containing phosphate in the form of apatite consists in subjecting them to flotation. Applied to the ore described above, flotation gives an enriched concentrate not only in phosphate but also in magnesium coumpounds.

Such compounds cannot currently be treated by classical industrial techniques. In effect, the presence of magnesium makes this treatment prohibitive. On one hand, magnesium consumes an important quantity of reactive at the time of acid lixiviation and, on the other hand, magnesium, in the course of the final treatment of the lixiviate, precipitates in the form of insoluble phosphate which is not useful in agriculture. This precipitation represents an important loss of phosphate and increases the cost of the process considerably.

Applied to phosphate ore with clay and/or carbonate containing gangue, the process of the present invention permits the elimination of a very important portion of the magnesium present in the ore in the form of fine particles (in general the portion is higher than 80%). If careful attrition has been sufficiently followed, the following phases are recovered in the fine particles: carbonate of calcium, magnesium carbonate, and clay.

The flotation of this pretreated ore according to the process of the present invention gives a compound which is at the same time very low in magnesium and very rich in phosphate. This compound is perfectly adapted to the processes usually used to treat apatite.

The use of this process for separating the zinc factory residues into two portions, one coarse and enriched in zinc and silica, the other fine and enriched in lead and silver, constitutes a particularly interesting application of the present invention.

As an example, one may point out that the following factory residues of zinc are essentially formed of the following phases: $ZnFe_2O_4$—$CaSO_4$, $2H_2O$—$CaSO_4$, $\frac{1}{2}H_2O$—$ZnSO_4$, $H_2O$—$PbSO_4$—ZnS—$SiO_2$.

The essential part of silver-bearing lead sulphate is found again in the fine particles (more than 80% in the case of a cut of 40 microns) as well as an important part of the calcium sulphate. The zinc-bearing compounds (ferrite) are found in the less coarse portions.

The process may be used in association with any other technique of physical enrichment.

This process of physical enrichment may be placed upstream or downstream from attrition.

The following examples have the goal of permitting specialists to determine easily the operative conditions which should be used in each particular case.

EXAMPLE 1: Enrichment by moist attrition of uranium ore (Episyenite of the vein of Pierres Plantees)

The ore is first ground to obtain a product with a particle size distribution lower than 1 mm.

Attrition according to the invention is carried out in a laboratory cell of one liter, Wemco type, furnished with an agitator turning 1250 turns per minute, that is, 6.6 meters per second, in which the solid concentration of the pulp is 60%.

The products obtained after 30 minutes are sifted to 63 microns, the portion passing this particle size distribution being then ranked in a micro-cyclone under pressure.

The preconcentrate according to the present invention is constituted by the overturning of the cyclone and its content of uranium is shown in the following table:

| Product | Weight % | Content in uranium % | Recovery of uranium in % |
|---|---|---|---|
| >63 microns | 47.3 | 0.17 | 28.0 |
| underflow of cyclone | 29.3 | 0.25 | 25.5 |
| overflow of cyclone(<10 pm) | 23.4 | 0.57 | 46.5 |
| feed | 100.0 | 0.29 | 100.0 |

It is thus possible to obtain a preconcentrate whose content is double that of the ore and which contains practically half of the metal contained in the beginning product. This result, already interesting, may further be improved by taking up again the coarse portions and submitting them again to the process described in the invention.

EXAMPLE 2: Enrichment by moist attrition of siderurgical dusts of Warren steelworks—U.S.A.

These dusts are composed of a mixture of different phases: spinels, $Fe_3O_4$, $ZnFe_2O_4$, $MnFe_2O_4$, and ZnO. They have the following composition:

Table I

| Chemical Composition | |
|---|---|
| Fe : 23.7% | $SiO_2$ : 3.32% |
| Zn : 29.1% | Na : 1.04% |
| Pb : 4.27% | K : 1.04% |
| Mn : 4.72% | Mg : 1.55% |
| Ca : 3.58% | Al : 0.32% |

This chemical composition is similar to that of the dusts produced generally in electric steel works. However, 75% of the zinc is in the form of free ZnO.

These dusts whose dimensions are already lower than 40 microns are treated by moist attrition in the conditions set out in Example 1.

The products obtained after 10 minutes of treatment are separated by sedimentation rather than by centrifugation in order to obtain different granulometric portions.

The results of the analysis of the portions thereby obtained are listed in Table II below:

TABLE II

| Fractions (in microns) | >23.5 | 8.9-23.5 | 2-8.9 | <2 | Feed |
|---|---|---|---|---|---|
| Weight (%) | 6.1 | 15.22 | 67.55 | 11.06 | 100% |
| Content in Zinc (%) | 9.0 | 24.6 | 30.0 | 41.0 | 29.1% |
| Distribution in Zinc (%) | 1.9 | 12.9 | 69.6 | 15.6 | 100% |
| Content in lead (%) | 1.7 | 4.3 | 4.5 | 4.25 | 4.27% |
| Distribution in lead (%) | 2.5 | 15.3 | 71.2 | 11.0 | 100% |
| Content in iron (%) | 35.2 | 26.2 | 23.20 | 17.40 | 23.75% |
| Distribution in iron (%) | 9.1 | 16.8 | 66.1 | 8.0 | 100% |

From this example, an attrition carried on according to the invention for a relatively short lapse of time, and followed by a fine cut-off size of 2 microns, permits the recovery of a portion which is notably enriched in zinc although the metal only represents 15.6% in weight of the metal contained in the product at the beginning.

It is also possible to improve this recovery rate by submitting the portions whose size is larger than two microns to a new attrition.

EXAMPLE 3: Attrition attempt on a phosphate ore with silicated and carbonized gangue—Fraction 63-500 microns In an attrition cell, Wemco type, of one liter whose agitator turns 800 turns per minute, 1097 grams of dry ore, 0.2 g of a dispersant sold by BASF (Badische Aniline & Soda-Frank AG) under the commerical name of "Polysel F" (a salt of a polycarboxylic acid) and a sufficient quantity of water to bring the percentage of solid in the pulp to 71.5% are introduced. The attrition is carried on for 20 minutes. At the end of this time, the amount of the solid is 70.6%.

The portion of ore used is the fraction 63-500 microns obtained after elutriation and elimination of the coarsest ones. The remainder of the ore after grinding to 500 microns is the subject of Example 4 following hereafter. The elutriation or washing consists in eliminating after turning into pulp the portion of less than 10 microns.

| % | Weight | B.P.L. | pBPL | MgO | pMgO | $SiO_2$ | $pSiO_2$ |
|---|---|---|---|---|---|---|---|
| feed before attrition | 100 | 15.60 | 100 | 0.46 | 100 | 73.73 | 100 |
| −50μ after attrition* | 3.5 | 12.48 | 2.8 | 7.32 | 55.7 | 33.1 | 1.6 |
| +50μ after attrition* | 96.5 | 15.71 | 97.2 | 0.21 | 44.3 | 75.18 | 98.4 |

-continued

*Margin of error : 7 microns
p = yield or recovery
B.P.L. = Bone Phosphate Lime
pB.P.L. = Yield or recovery of Bone Phosphate Lime
pMgO = Yield or recovery of MgO
$pSiO_2$ = Yield or recovery of $SiO_2$ This concentrate (portion having a particle size exceeding 50 microns), submitted to a flotation attempt, gives a concentrate containing 28.70% of $P_2O_5$ (equivalent to 62.81% of B.P.L.) and 0.77% of magnesia with a recovery rate of 66.6% of phosphates.

The reagent used for this flotation was the product sold under the commercial name "PAMAK 4" (a fatty acid collecter used as a flotation reagent) which was used at a pH near 10 and in the presence of sodium silicate. The cell used was the MINEMET cell of 2.5 liters operating at 1630 turns per minute, described in French Pat. No. 75-25429.

EXAMPLE 4: Attrition attempt on a phosphate ore with silicated and carbonate containing gangue Another portion of the ore used in the preceding example was treated in the same conditions as before, with the exclusion of the percentage of solid which was 54% at the beginning and 49.7% at the end.

| % | Weight | B.P.L. | pBPL | MgO | pMgO | $SiO_2$ | $pSiO_2$ |
|---|---|---|---|---|---|---|---|
| feed before attrition | 100 | 19.96 | 100 | 7.44 | 100 | 25.63 | 100 |
| −40μ after attrition* | 58.7 | 6.55 | 19.4 | 11.59 | 91.5 | 21.65 | 49.6 |
| +40 μ after attrition* | 41.3 | 38.74 | 80.6 | 1.53 | 8.5 | 31.27 | 50.4 |

*margin of error: 5 microns
p = yield or recovery
B.P.L. = Bone Phosphate Lime
pB.P.L. = Yield or recovery of Bone Phosphate Lime
pMgO = Yield or recovery of MgO
$pSiO_2$ = Yield or recovery of $SiO_2$

What is claimed is:

1. A process for the preconcentration of metalliferous values contained in a metal-bearing ore material selected from the group consisting of an ore and a by-product thereof, comprising:
   (a) subjecting the ore material to careful attrition, so that the fraction $d_{80}/d_{20}$, wherein
      $d_{80}$ represents the smallest mesh which permits 80% of the ore material to pass through, and
      $d_{20}$ represents the smallest mesh which permits 20% of the ore material to pass through
      increases in the course of successive attritions; and
   (b) recovering a cut containing the metalliferous values in concentrated form from the resulting attrited particle mixture.

2. A process for the preconcentration of metalliferous values contained in a metal-bearing ore material selected from the group consisting of an ore and a by-product thereof, comprising:
   (a) subjecting the ore material to careful attrition to obtain a particle mixture consisting of fine and coarse particles so that the fraction $d_{80}/d_{20}$, wherein $d_{80}$ represents the smallest mesh which permits 80% of the ore material to pass through, and $d_{20}$ represents the smallest mesh which permits 20% of the ore material to pass through, increases in the course of successive attritions; and (b) separating the fine particles from the coarse particles; and (c) recovering from the fine particles a cut consisting essentially of particles having a particle size not exceeding about 50 microns and containing the metalliferous values in concentrated form.

3. The process of claim 2 wherein the fine cut consists essentially of particles having a particle size not exceeding about 10 microns.

4. The process of claim 2 wherein the ore is pulverized prior to being subjected to the careful attrition of step (a).

5. The process of claim 2 wherein step (b) is carried out by a classification.

6. The process of claim 2 wherein the metal-bearing ore material is a member selected from the group consisting of uranium ores with carbonized gangue, manganese ores of sedimentary origin, phosphate ores with clay and/or carbonate containing gangue, bauxite ores of breccia structure where the bauxite is accompanied by silicified limestone, talc ores associated with a schist and a granite gangue and containing fine amounts of dolomite and pyrite, factory residues of zinc, and siderurgical dusts recovered from the exhausts of blast-furnaces and steelworks.

7. The process of claim 2 wherein the metal-bearing ore material is an ore which is transformed into a pulp before being subjected to the careful attrition of step (a).

8. The process of claim 7 wherein the transformation of the ore into a pulp is directly carried out on the vein by hydraulic breakage of the ore.

9. The process of claim 7 wherein the careful attrition of the pulp is carried out by simple agitation of the pulp.

10. The process of claim 2 wherein the metal-bearing ore material is transformed into a pulp, the pulp then subjected to careful attrition to obtain a particle mixture consisting essentially of fine particles in the form of a pulp and coarse particles in the form of a pulp, separating the fine particles in the form of a pulp from the coarse particles in the form of a pulp, mixing the separated fine particles in the form of a pulp with a flocculant at a pH to thicken the pulp of the fine particles, and recovering a fine cut, consisting essentially of particles having a particle size not exceeding about 50 microns and containing the metalliferous values in concentrated form, from the thickened pulp.

11. The process of claim 10 wherein the flocculant is an organic flocculant having at least one polar group selected from the group consisting of an amide, ether, and ester group.

12. The process of claim 10 wherein the flocculant is employed in an amount of about from 100 to 2000 grams of flocculant per ton of the dry particles issuing from the careful attrition step.

13. The process of claim 10 wherein the flocculant is employed in an amount of about from 100 to 500 grams of flocculant per ton of dry particles issuing from the careful attrition step.

14. The process of claim 2 wherein the careful attrition step is carried out in a dry format.

15. The process of claim 2 wherein the careful attrition step is carried out by means of a mill.

16. The process of claim 2 wherein the attrition step is carried out by means of the particles obtained from a previous attrition of the same metal-bearing ore material as the attrition medium.

17. The process of claim 16 wherein the particles obtained from the previous attrition have a particle size of about from 100 microns to 5 mm.

18. The process of claim 2 wherein the coarse particles obtained in step (b) are subjected to at least one additional careful attrition step (a) and thereafter processed according to steps (b) and (c) until an essentially complete separation of all the metal values has been accomplished.

19. The process of claim 2 wherein the ore material is the factory residue of zinc, the fine particles obtained are concentrated in lead and silver, and the coarse particles obtained are concentrated in zinc and silica.

20. The process of claim 2 wherein the ore material is a phosphate ore with clayey and/or carbonate containing gangue, and the fine particles obtained are concentrated in calcium carbonate, magnesium carbonate, and clay, while the coarse particles are concentrated in phosphate.

21. The method of claim 2 wherein the careful attrition step is carried out in a pulp, the amount of solid in the pulp is between 40% and 80%.

22. The method of claim 21 wherein the amount of solid in the pulp is between 65% and 75%.

* * * * *